US007574834B2

(12) United States Patent
Murray

(10) Patent No.: US 7,574,834 B2
(45) Date of Patent: Aug. 18, 2009

(54) ABOVE GROUND WATER STORAGE SYSTEM AND METHOD

(76) Inventor: Michael Lance Murray, P.O. Box 1913, Vernal, UT (US) 84078

( * ) Notice: Subject to any disclaimer, the term of this patent is extended or adjusted under 35 U.S.C. 154(b) by 48 days.

(21) Appl. No.: 11/800,053

(22) Filed: May 2, 2007

(65) Prior Publication Data

US 2007/0264083 A1 Nov. 15, 2007

Related U.S. Application Data

(60) Provisional application No. 60/798,271, filed on May 4, 2006.

(51) Int. Cl.
*E02D 27/00* (2006.01)

(52) U.S. Cl. ..... 52/169.7; 52/169.8; 52/245; 249/47; 249/194; 249/159; 405/52; 405/129.6; 4/506; 4/585

(58) Field of Classification Search ..... 52/169.7, 52/169.8, 245; 249/47, 194, 159; 405/52, 405/129.6; 4/506, 585
See application file for complete search history.

(56) References Cited

U.S. PATENT DOCUMENTS

| | | | | |
|---|---|---|---|---|
| 3,735,427 | A | 5/1973 | Ancewicz et al. | |
| 3,797,049 | A | 3/1974 | De Santo | |
| 4,136,995 | A | 1/1979 | Fish | |
| 4,473,978 | A | 10/1984 | Wood | |
| 5,129,170 | A * | 7/1992 | Fusilli | 37/231 |
| 5,232,246 | A | 8/1993 | Page | |
| 5,454,195 | A | 10/1995 | Hallsten | |
| 5,489,165 | A | 2/1996 | Smith | |
| 5,605,416 | A | 2/1997 | Roach | |
| 5,713,085 | A | 2/1998 | Enns | |
| 5,970,531 | A * | 10/1999 | Demby | 4/498 |
| 6,079,904 | A * | 6/2000 | Trisl | 405/107 |
| 6,132,140 | A | 10/2000 | Kullberg | |
| 6,230,451 | B1 | 5/2001 | Stoller | |
| 6,647,562 | B1 | 11/2003 | Arout et al. | |
| 6,676,333 | B2 | 1/2004 | Wiseman et al. | |
| 6,840,711 | B1 | 1/2005 | Martinez et al. | |
| 6,854,926 | B2 * | 2/2005 | Siglin et al. | 405/52 |
| 6,935,809 | B2 | 8/2005 | Svensson | |

OTHER PUBLICATIONS www.loomistank.com/vertical.html, "Above-Ground Vertical Water Storage," 3 pages 2006 Lommis Tank Centers.

* cited by examiner

*Primary Examiner*—Jeanette E Chapman
*Assistant Examiner*—Daniel Kenny
(74) *Attorney, Agent, or Firm*—Thorpe North & Western, LLP

(57) ABSTRACT

An above ground water storage device includes a plurality of modular walls coupled together in series to form a substantially continuous perimeter. Each of the plurality of modular walls includes a wall panel that is inclinable with respect to a horizontal orientation, and a support base that is coupled to a portion of the wall panel. A liner covers an internal side of the plurality of modular walls and an area encompassed by the continuous perimeter. At least one modular corner wall is positioned with the plurality of modular wall panels to form a corner in the substantially continuous perimeter. The at least one modular corner wall has an angled side with an angle corresponding to the inclined angle of an adjacent modular wall.

9 Claims, 7 Drawing Sheets

ABOVE GROUND WATER STORAGE SYSTEM AND METHOD

PRIORITY CLAIM

This application claims benefit of U.S. Provisional Patent Application 60/798,271 filed on May 4, 2006, which is incorporate herein by reference in its entirety for all purposes.

BACKGROUND OF THE INVENTION

1. Field of the Invention

The present invention relates generally to above ground water storage devices such as water retention ponds, evaporation ponds, and the like.

2. Related Art

Many large industrial projects, such as construction sites and oil or gas wells use tremendous amounts of water both in operations and clean up of the work site and equipment. Often such projects are not close to a plentiful water supply and must ship water to the project site. To minimize cost and logistical problems with continual shipping, and to insure an adequate amount of water is available to the project, temporary water storage facilities are usually developed near the project site.

Typically, such temporary storage facilities consist of a large hole excavated at or near the site with a water resistant liner disposed in the hole. The liner is then filled with water creating a temporary pond or reservoir to which water can be shipped via truck. When the project is finished, the remaining water is removed and the hole is filled in.

These types of temporary ponds are expensive to create, maintain and recover, and can be problematic to operate. For example, due to the amount of water needed for the industrial activity, the size of the hole required can be substantial, and the excavation costs alone can exceed hundreds of thousands of dollars. Moreover, recovery and clean up costs can be at least as expensive as installation costs.

Another problem with this type of below-ground temporary water storage is that the liners can leak water from the pond into the surrounding terrain. This is especially problematic when the temporary pond includes drilling lubricant or tailings and the water escaping the liner contaminates ground water sources. Because temporary ponds are below ground, such a leak is likely to go undetected until ground water sources are sufficiently polluted to manifest the contamination.

Additionally, below ground water storage facilities are difficult to resize in the event that more or less water is needed in the water storage facility. Resizing such water storage facilities typically requires additional excavation to either increase the depth or area of the water storage facility.

SUMMARY OF THE INVENTION

It has been recognized that it would be advantageous to develop a method and device for temporarily storing large amounts of water that does not require expensive excavation of a ground surface. In addition, it has been recognized that it would be advantageous to develop a method and device to temporarily store large amounts of water above ground to increase the chance of detecting water leakage and reduce the chance of contaminating ground water supplies. It has also been recognized that it would be advantageous to develop a sizable temporary above ground water storage device that can be sized in height and enclosed area to increase the volume of water stored.

The invention provides an above ground water storage device including a plurality of modular walls coupled together in series to form a substantially continuous perimeter. Each of the plurality of modular walls can include a wall panel that can be inclinable with respect to a horizontal orientation, and a support base that can be coupled to a portion of the wall panel. A liner can cover an internal side of the plurality of modular walls and an area encompassed by the continuous perimeter. At least one modular corner wall can be positioned with the plurality of modular wall panels to form a corner in the substantially continuous perimeter. The at least one modular corner wall can have an angled side with an angle corresponding to the inclined angle of an adjacent modular wall.

In another aspect, the inclined angle between the wall panel and the support base can be adjustable so as to position the wall panel at a predetermined angle with respect to the support base. The predetermined angle can correspond to a desired volume of water to be retained by the above ground storage device.

The present invention also provides for a method for forming an above ground water storage device including placing a plurality of modular walls in a perimeter pattern on a ground surface. Each of the plurality of modular walls can have a wall panel with a support base movably coupled the wall panel. The wall panel can be inclined with respect to the support base such that the wall panel can be inclined from a horizontal orientation while the support base can extend away from the wall panel in a substantially horizontal orientation. A brace can be positioned between the support base and the wall panel in order to secure the wall panel in the inclined position with respect to the support base and forming an inclined modular wall panel. Each of the inclined modular walls can be joined together to form a substantially continuous perimeter having an internal wall panel surface and encompassing an area within the perimeter. A liner can be placed over the internal wall panel surface and the area encompassed within the perimeter to form the above ground water storage device.

Additional features and advantages of the invention will be apparent from the detailed description which follows, taken in conjunction with the accompanying drawings, which together illustrate, by way of example, features of the invention.

DETAILED DESCRIPTION

Figure 1:
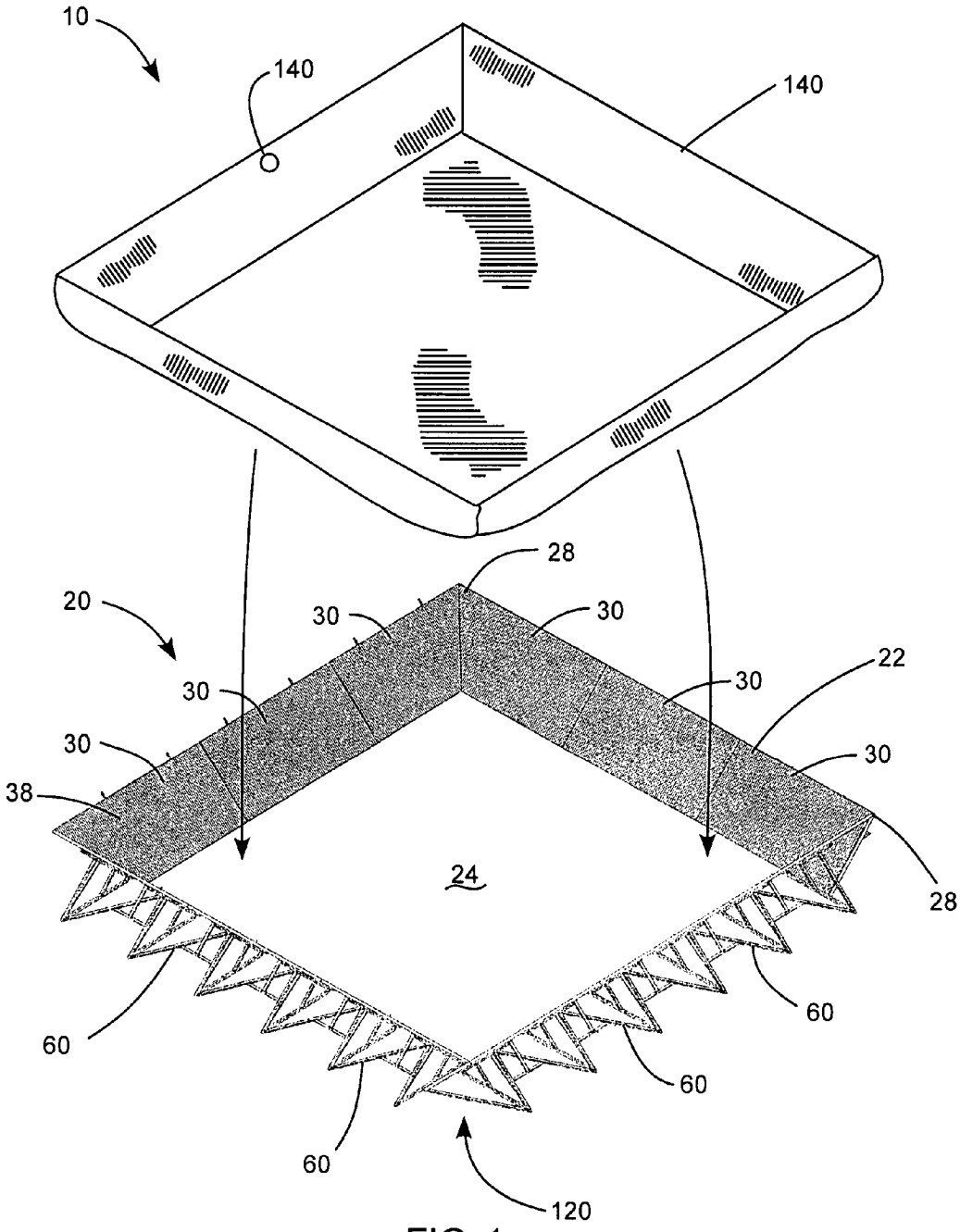
FIG. 1 is a perspective view of an above ground water storage device in accordance with an embodiment of the present invention, shown in without a liner or water disposed therein.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

The embodiments of the present invention described herein generally provide for an above ground water storage device having a plurality of modular walls that form a substantially continuous perimeter. A liner can be placed over the walls and the liner can be filled with water to form a reservoir or pond. The modular walls can include a wall panel and a support base. The support base can be pivotally coupled to a bottom of the frame and can pivot away from the wall panel. The support base can have a substantially horizontal orientation and the wall panel can be oriented at an inclined angle with respect to the wall panel. The angle of the inclined wall panel can be adjusted as necessary to support different volumes of water in the water storage device. A plurality of modular walls can be joined together to form a substantially continuous perimeter of an above ground water storage device such as a reservoir or pond. Corner wall panels that have a beveled or angled side corresponding to the angle of the incline of the modular walls can be used to form comers in the perimeter such that the perimeter forms a substantially continuous enclosure. The liner can be placed over the perimeter and filled with water to form the above ground water storage device.

The present invention also provides for a method for storing water above ground including erecting a plurality of modular walls. Each wall can have a wall panel pivotally coupled to a support base. The support base can be pivoted away from the wall panel to a substantially horizontal position so that the wall panel is at an inclined angle with respect to the support base. A brace can be placed between the wall panel and the support base to maintain the inclined position of the wall panel. The plurality of modular walls can be joined together to form a perimeter of an above ground pond or reservoir. A liner can be placed over the perimeter and filled with water to fill the pond.

Advantageously, the above ground storage device can be relatively easy to set-up or construct, and relatively easy to disassemble and transport. Additionally, the system of the present invention can be moved and reused in another location.

Figure 2:
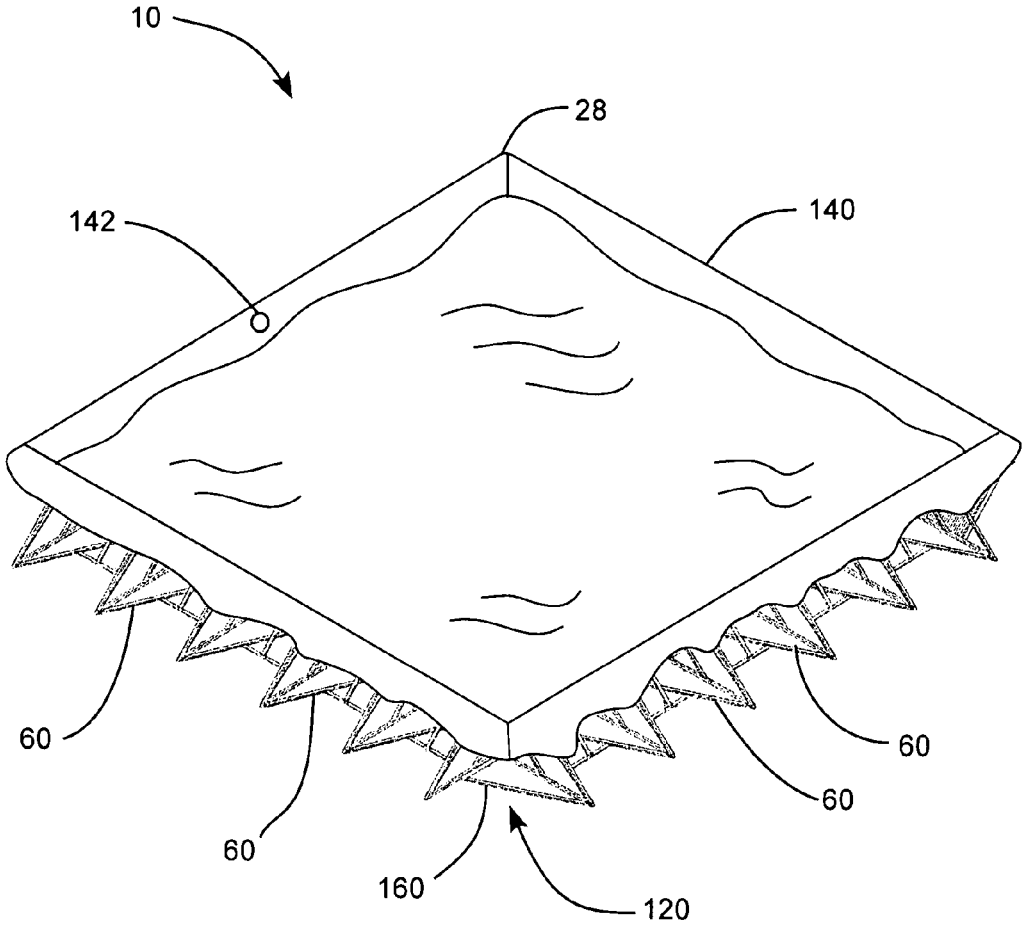
FIG. 2 is a perspective view of an above ground water storage device in accordance with an embodiment of the present invention, shown in with a liner and water disposed therein.

As illustrated in FIGS. 1-2, an above-ground water storage device, indicated generally at 10, in accordance with an embodiment of the present invention is shown for use in storing water in an above ground storage device such as a portable retention pond or reservoir. The above ground water storage device can include a plurality of modular walls, indicated generally at 20, at least one modular corner wall, indicated generally at 120, and a liner 140 covering the modular walls and corner walls.

The plurality of modular walls 20 can be coupled together in series with each other and the modular corner walls 120 to form a substantially continuous perimeter 22. Each of the plurality of modular walls 20 can include a wall panel 30 and a support base 60. The support base 60 can be placed on a ground surface with little preparation, such as excavation, or the like of the ground surface. The wall panel 30 can extend upward from the support base 60.

Figure 3:
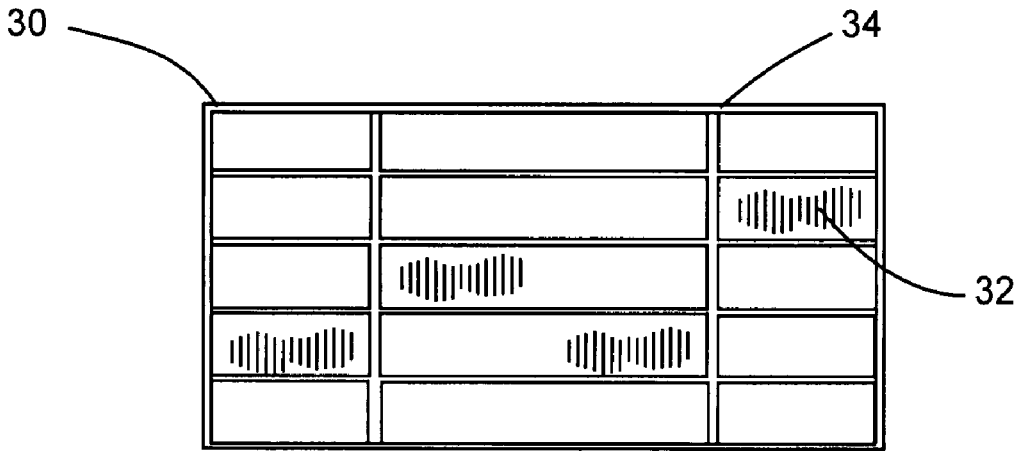
FIG. 3 is a rear view of a wall panel of the above ground water storage device of FIG. 1.
Figure 4:
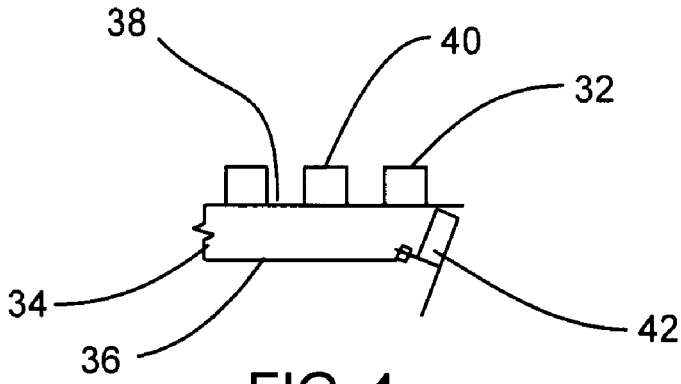
FIG. 4 is a top view of a portion of the wall panel of FIG. 3.

Referring to FIGS. 3-4, each of the wall panels 30 can include a wall membrane 32 coupled to a support frame 34. The wall membrane 32 can be positioned on the internal side 38 of the wall panel 30 and can include corrugations 40 to increase the stiffness and strength of the wall membrane 32. In one aspect the wall membrane 32 can be a sheet of corrugated metal, such as steel, aluminum, or the like. The wall membrane 32 can form the substantially continuous perimeter 22 and enclose an area 24 within the continuous perimeter.

The support frame 34 can be coupled to an external side 36 of the wall panel 30. The support frame 34 can be made from a material having sufficient strength to support the wall membrane 32 when a load is applied to the wall membrane by water stored in the above ground storage device 10. For example, the support frame 34 can include square tubing, or the like made from a metal material such as steel.

The wall panels 30 can be inclinable with respect to the support base 60. In this way, the wall panels 30 can be inclined with respect to a horizontal orientation, or a ground surface level. In one aspect, the wall panels 30 can be inclined with respect to the support base 60 at substantially 45 degrees. In another aspect, the inclined angle between the wall panels 30 and the support base 60 can be adjustable.

Angling or inclining the wall panels 30 provides several advantages to the above ground storage device 10. For example, the angle of the wall panels 30 can transfer at least some of the substantial lateral or outward force due to the weight and pressure of the water in the water storage device 10 to a downward force against the ground. Additionally, the inclined angle between the wall panel 30 the support base 60 can be adjusted to a predetermined angle that can correspond to a desired volume of water to be retained by the above ground storage device 10. In this way, the wall panel 30 can support a larger volume of water in the above ground storage device 10.

The support frame 34 of the wall panel 30 can be coupled to the support base 60. The support frame 34 can include a plurality of connectors such as hinges 42 that can receive the support base 40.

Figure 5:
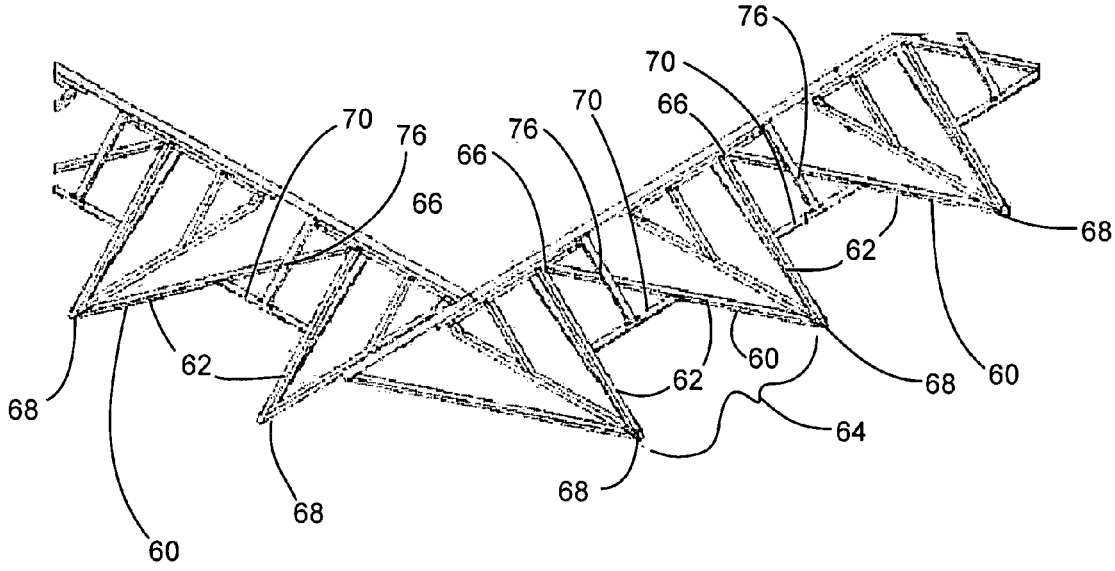
FIG. 5 is a front view of a corner wall panel of the above ground water storage device of FIG. 1.
Figure 6:
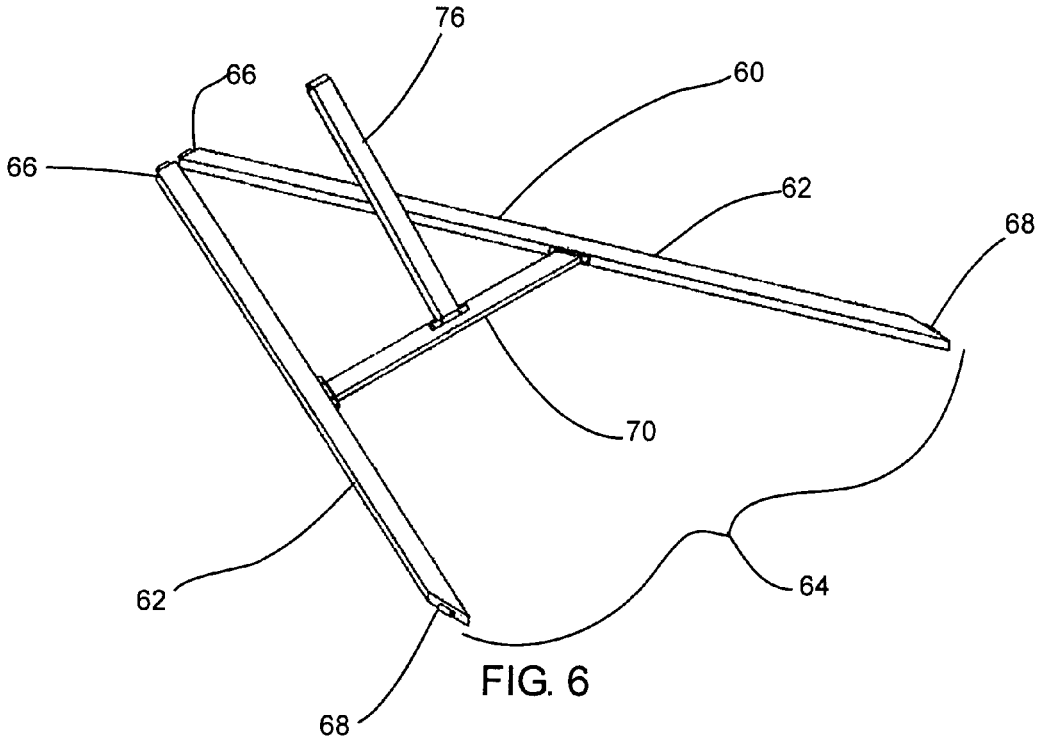
FIG. 6 is a partial perspective view of a the device of FIG. 1.

Referring to FIGS. 5-6, the support base 60 can be movably or pivotally coupleable to a lower portion of the support frame 34 of the wall panel 30. The support base 60 can include two substantially horizontal legs 62. The legs 62 can define an A-frame, indicated generally at 64, with a proximal end 66 of each leg adjacent one another and a distal end 68 of each leg spaced apart from one another. A horizontal cross brace 70 can extend between the legs 62 intermediate the proximal ends 66 and the distal ends 68.

The support base 60 can be made from materials with sufficient strength to support the wall panel 30 when water is disposed in the above ground storage device 10. For example, the legs 62 of the A-frame 64 can be made from a structural material such as wood or metal. In one aspect, the legs 62 can be made from wood beams. In another aspect, the legs 62 can be made from square or rectangular steel tubing. Other structural material, as known in the art, can also be used.

The support base 60 of each modular wall 20 can be moveable between a storage position (not shown) and an inclined position as shown in FIG. 6. In the storage position, the support base 60 and wall panel 30 can be substantially parallel and adjacent on another so that the modular wall 20 is relatively flat and compact. It will be appreciated that the relatively flat and compact configuration of the modular wall 20 in the storage position can facilitate shipping and storage of the modular walls.

In the inclined position, the wall panel 30 can form an inclined angle with respect to the support base 60. In one aspect, the support base 60 can be placed in a substantially horizontal orientation, such as on a leveled ground surface, and the wall panel 30 can be pivoted upward to form an inclined angle with the support base 60. A upwardly extending brace 76 can be disposed between the wall panel 30 and the support base 60 to secure the wall panel and the support base in the inclined position, and to support the wall panel when water fills the above ground storage device 10. In this way, the modular walls 20 can be easy to assemble or construct, and easy to disassemble and transport for reuse. Specifically, the support base 60 and wall panel 30 can be pivoted or collapsed together to reduce their size for easy stacking for storage and transportation. Additionally, the support base 60 and wall panel 30 can be pivoted open and locked in place with the brace 76 for use in forming the above ground water storage device 10.

It will be appreciated that the wall panels and support bases can be removably coupled together so that the wall panels and support bases can be assembled and disassembled between storage and transportation configuration, and an assembled use configuration.

Figure 7:
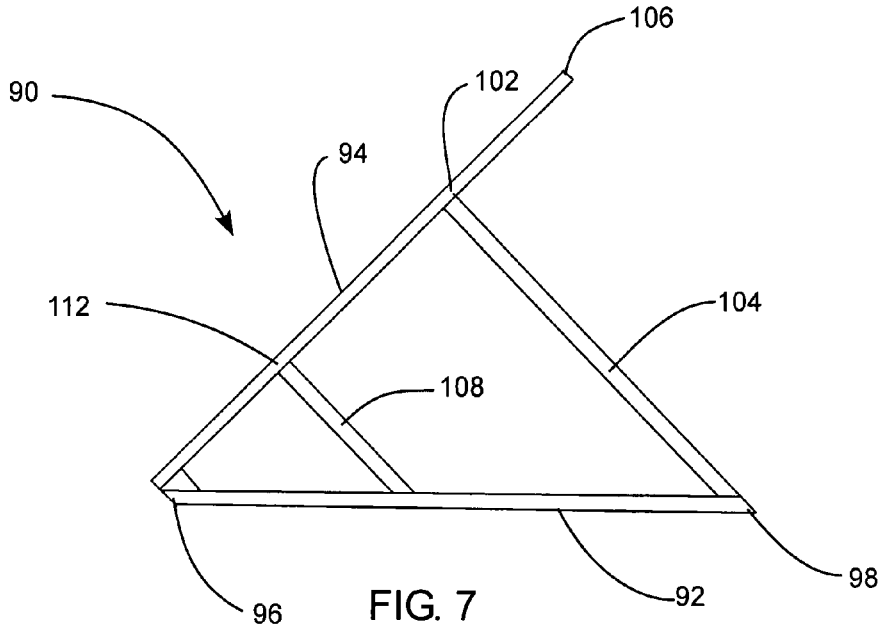
FIG. 7 is a perspective view of a support base of the above ground water storage device of FIG. 1.

Referring to FIG. 7, the support base 60 can also include a structural frame or truss, indicated generally at 90 to support the wall panel 30 in the pivoted position. The truss can have a lower member 92 and an upper member 94. The lower member 92 can be a horizontal member in a plane parallel with the horizontal legs 62. The upper member 94 can be an inclined member in a plane substantially parallel to the inclined plane of the wall panel 30. The lower member 92 can have a proximal end 96 adjacent the wall panel 30 and a distal end 98 coupleable to a distal end 68 of one of the substantially horizontal legs 64.

The truss 90 can also include at least one spar 100 intermediate the proximal end 96 and the distal end 98 of the truss 90. In one aspect, the truss 90 can include an outer spar 104 and an inner spar 108. The outer spar 104 can extend from the distal end 98 of the lower member 92 to a point 102 near an upper end 106 of the upper member 94. The inner spar 108 can extend from a location 110 intermediate the proximal and distal ends 96 and 98 of the lower member to a point 112 on the upper member lower than the upper end. Thus, the spars 104 and 108 can extend upward from the lower member of the truss 90 to support the wall panel 30.

Figure 8:
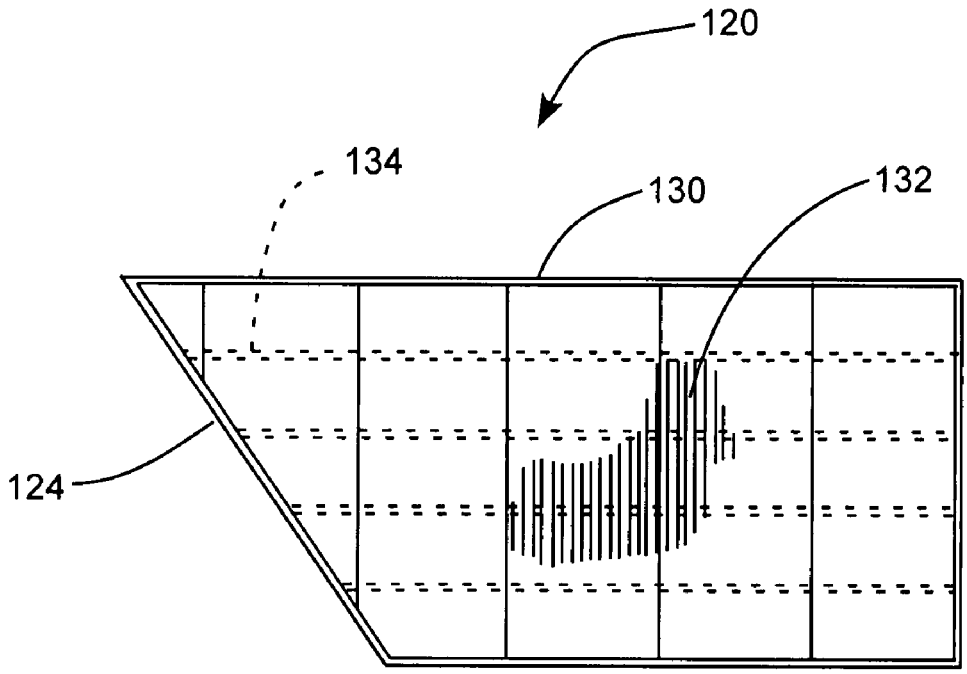
FIG. 8 is a side view of a truss of the above ground water storage device of FIG. 1.

Referring to FIGS. 1 and 8, the at least one modular corner wall 120, can be positionable with the plurality of modular wall panels 20 to form a corner 28 in the substantially continuous perimeter 22. The corner 28 can change the direction of the substantially continuous perimeter 22 so as to enable the perimeter to enclose the area 24 within the perimeter. The modular corner wall 120 can be similarly in many respects to the modular walls 20 including a wall panel 130 with a frame 134 and a wall membrane 132, and a support base 160. Additionally, the corner wall 120 can have a beveled or angled side 124. The angle of the angled side can correspond to the inclined angle of an adjacently placed modular wall 20.

Returning to FIGS. 1 and 2, the liner 140 can cover the internal side 38 of the modular walls 20 and the area 24 encompassed by the continuous perimeter 22. The liner 140 can include a water and tear resistant material, such as a Kevlar reinforced flexible plastic or elastomeric material, as known in the art. The liner 140 can have an opening 142 associated with an opening (not shown) in one of the wall panels. The openings can be sized and shaped to allow water to fill, or drain from, the above ground water storage device 10. In this way, the liner 140 can be filled with water such to form a portable retention pond or reservoir.

Figure 9:
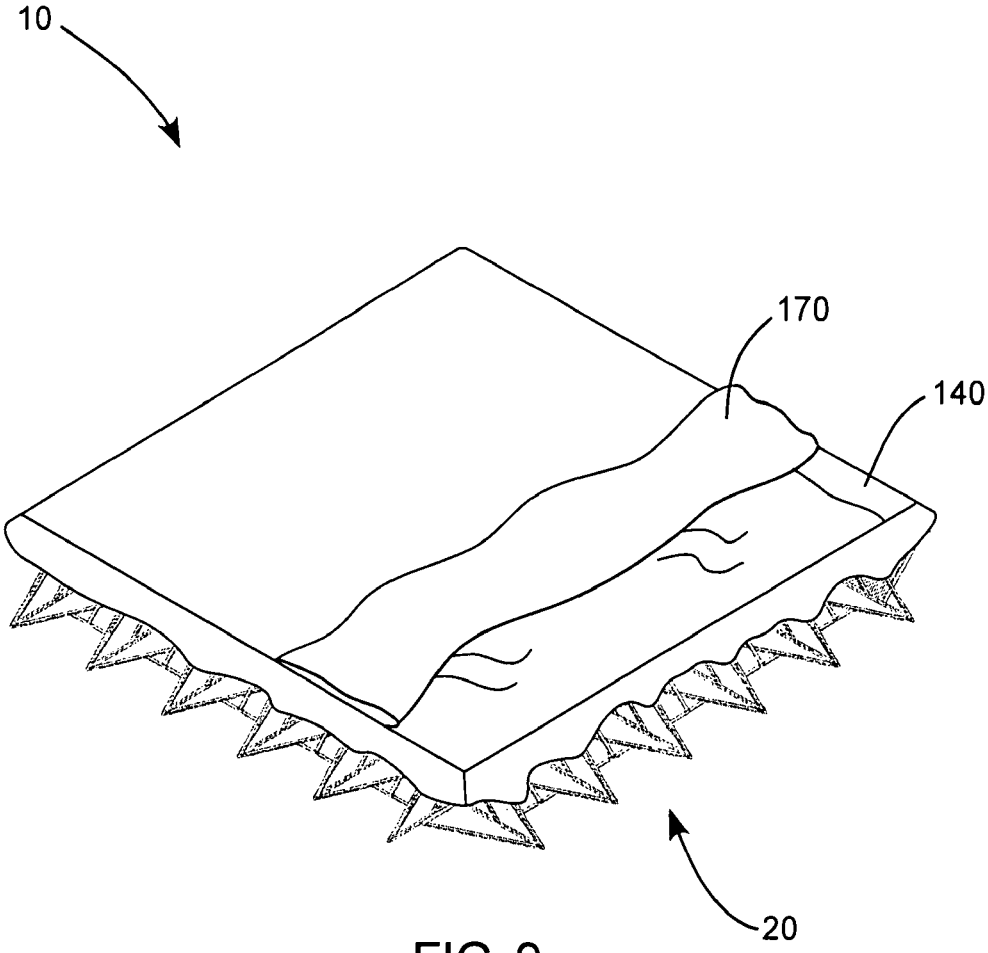
FIG. 9 is a perspective view of the above ground water storage device of FIG. 1, shown with a cover over water filled liner.

Referring to FIG. 9, the above ground storage device 10 can also include a cover 170 sized and shaped to fit over the above ground storage device. The cover can be placed on top of water stored in the liner 140. In one aspect, the cover 170 can be formed from the same flexible material as the liner 140. In another aspect, the cover 170 can be a rigid material such as a hardened plastic.

It is a particular advantage of the present invention that the modular walls 20 can be erected on a ground surface without excavation below the naturally occurring ground surface level. It will be appreciated that while the ground surface can be prepared for the modular walls 20 and liner by leveling the ground surface and removing above ground obstacles and debris, such as rocks and tree stumps, excavation below ground level is not needed to practice the invention herein described. Thus, advantageously, the embodiment of the present invention described herein can save considerable time and expense in excavating a hole to support the water storage device.

It is another particular advantage of the embodiment of the water storage device 10 described herein that the modular walls 20 and liner 140 can all rest on and extend upward from a naturally occurring ground surface so that the liner is disposed entirely above the ground surface level. It will be appreciated that having the liner 140 above ground surface level increases the chances of detecting water leakage from the liner and reduces the chances of contaminating ground water supplies.

It will also be appreciated however, that the present invention could be combined with an excavated hole in order to increase the storage capacity of the retention pond. For example, a hole can be excavated and the modular walls 20 can be erected to form a substantially continuous perimeter around the hole, thereby increasing the depth of the wall of the retention pond. A relatively larger liner can then be disposed over the wall 20 and into the hole and the liner can be filled with water to a depth from near the top of the modular wall 20 to the bottom of the hole. In this way, a greater amount of water can be stored without expanding the size of the substantially continuous perimeter.

Another advantage of the water storage device 10 is that the volume of water held by the water storage device 10 can be increased or decreased simply by increasing or decreasing the number of modular walls 20 used to form the continuous perimeter 22. It will be appreciated that in a typical oil or gas drilling operation, tens of thousands of gallons of water can be required to lubricate, clean, and maintain drilling and well equipment. Advantageously, the water storage device can be sized to hold a sufficient amount of water to service a single well, or many wells, as circumstances may require.

Another advantage of the present invention is that the water storage device 10 can be shaped and sized to accommodate localized terrain and geography. Specifically, a water storage device 10 can be generally quadrangular, as shown in FIGS. 1-2, or additional corner walls 120 can be added to make the general shape of the substantially continuous perimeter 22 polygonally shaped. In this way, the water storage device 10 can be shaped to fit in the space available for the water storage device, or around large obstacles in the water storage device space. In addition, the water storage device 10 can be configured to match the size or shape of the particular site. Thus, the storage device can be square, rectangular, or polygonal, as needed. It will be appreciated that additional shapes can be used, including for example, circular, L-shaped, U-shaped, V-shaped, etc.

The present invention also provides for a method for forming an above ground water storage including laying a plurality of modular wall panels in a perimeter pattern on a ground surface. Each of the plurality of modular wall panels can have a wall panel with a support base pivotally coupled to the wall panel. The wall panel of each modular wall panel can be pivoted upward from the ground surface so that the wall panel is inclined from a horizontal orientation. The support base can be pivoted away from the wall panel to a pivoted position so the support base extends away from the wall panel in a substantially horizontal orientation. A brace can be placed between the support base and the wall panel to secure the support base and wall panel in the pivoted position and forming an inclined modular wall panel. Each of the inclined modular walls can be joined to form a perimeter having an internal wall panel surface and encompassing an area within the perimeter. A liner can be placed over the internal wall panel surface and the area encompassed within the perimeter to form the above ground water storage device.

The method can also include laying the plurality of modular wall panels further includes preparing the ground surface to receive the water storage device. For example, brush, debris, and obstacles can be removed from the ground and the ground can be leveled. Additionally, a surface material, such as gravel, roadbase, sand, or the like, can be laid to protect the liner.

The method can also include connecting a pipe to the liner and extending the pipe through one of the wall panels. Additionally, the method can include filling the liner with water to form an above ground retention pond or reservoir.

The method can also include digging a retaining trench around the above ground water storage device; and digging a tailings pond adjacent the above ground water storage device and connecting the tailings pond to the trench; and pumping water from the tailings pond into the above ground water storage device. In addition, the method can include placing a modular concrete barrier around at least a portion of a perimeter of the above ground water storage device. The method can also include removing the water; removing the liner; disassembling the modular walls from one another; configuring the wall panels and support bases in a storage configuration; and removing the modular walls from the site.

The present invention also provides for a method for forming an above ground water storage device including placing a plurality of modular walls in a perimeter pattern on a ground surface. Each of the plurality of modular walls can have a wall panel with a support base movably coupled the wall panel. The wall panel can be inclined with respect to the support base such that the wall panel can be inclined from a horizontal orientation while the support base can extend away from the wall panel in a substantially horizontal orientation. A brace can be positioned between the support base and the wall panel in order to secure the wall panel in the inclined position with respect to the support base and forming an inclined modular wall panel. Each of the inclined modular walls can be joined together to form a substantially continuous perimeter having an internal wall panel surface and encompassing an area within the perimeter. A liner can be placed over the internal wall panel surface and the area encompassed within the perimeter to form the above ground water storage device.

The method can also include positioning an angled side of a corner wall adjacent one the inclined wall panel of one of the plurality of modular walls. The angle of the side of the corner wall can correspond to the inclined angle of the adjacent wall panel. Additionally, the angled side of the corner wall can form a corner of the continuous perimeter to change the direction of the continuous perimeter formed by the modular walls.

The method can also include placing the liner in fluid communication with a well drilling operation such that well completion and production fluid can flow between the well drilling operation and the above ground water storage device. Additionally, fluid from the well drilling operation can be stored in the liner to reduce hauling the fluid away from the well drilling operation by motor vehicles.

The method can also include filling the liner with water to form a portable retention pond. Additionally, the water can be removed from the liner, and the liner can be removed from the modular walls. The modular walls can also be disassembled from one another. The wall panels and support bases can be moved to a storage configuration with the support base and wall panel substantially parallel and adjacent on another. The modular walls in the storage configuration can be from the ground surface.

The method can also include preparing the ground surface to receive the water storage device. For example, the ground can be cleared and leveled, and a suitable base material, such as concrete, asphalt, sand, gravel, road base, or the like can be laid down for the above ground storage device to be constructed upon.

The step of inclining the wall panel can also include adjusting the angle of inclination between the wall panel and the support base so as to place the wall panel at a predetermined angle with respect to the support base. The predetermined angle can correspond to a desired volume of water in the above ground storage device.

It will be appreciated that the above ground water storage device can supply water for many temporary industrial and agricultural uses. For example, the above ground water storage device can provide a reservoir of water that may be used by forest service or other fire fighting personnel in fighting forest fires. Additionally, the portable pond can be used to as a temporary water reservoir for livestock or wild life on open range lands or feed lots. The portable pond can also be used as a temporary water reservoir in dry farming regions where water from seasonal snow melt can be captured and used in dry months or times of drought for irrigating crops. The above ground water storage device can also be used as a temporary evaporation or settling pond for a variety of industrial applications such as mining, smelting, fracking, logging, and the like.

It is to be understood that the above-referenced arrangements are only illustrative of the application for the principles of the present invention. Numerous modifications and alternative arrangements can be devised without departing from the spirit and scope of the present invention. While the present invention has been shown in the drawings and fully described above with particularity and detail in connection with what is presently deemed to be the most practical and preferred embodiment(s) of the invention, it will be apparent to those of ordinary skill in the art that numerous modifications can be made without departing from the principles and concepts of the invention as set forth herein.

What is claimed is:

1. An above ground water storage device, comprising:

a) a plurality of modular walls, coupled together in series to form a substantially continuous perimeter, each of the plurality of modular walls further including:

i) a wall panel, inclined with respect to a horizontal orientation at an inclined angle; and ii) a support base, coupled to an A-frame portion of the wall panel the A-frame support base, including two legs defining a horizontal A-frame shape with a proximal end of each leg adjacent each other and a distal end of each leg spaced apart from one another, a cross brace extending between the legs intermediate the proximal and distal ends, and a truss having an upper leg member and a lower leg member with the upper leg member extending upward along the inclined wall panel and the lower leg member coupled to one of the A-frame legs;

b) a liner, covering an internal side of the plurality of modular walls and an area encompassed by the continuous perimeter; and c) at least one modular corner wall, positioned with the plurality of modular wall panels to form a corner in the substantially continuous perimeter, the at least one modular corner wall having an angled side with an angle substantially the same as the angle of the inclined angle of an adjacent modular wall, and a non-angled side coupleable together in series with one of the plurality of modular walls.

2. A device in accordance with claim 1, wherein the inclined angle between the wall panel and the support base is adjustable so as to position the wall panel at a predetermined angle with respect to the support base in response to a desired volume of water to be retained by the above ground storage device.

3. A device in accordance with claim 1, wherein each support base is moveable between a storage position in which the support base and wall panel are substantially parallel and adjacent one another, and an inclined position in which the wall panel forms an inclined angle with the support base, and further includes a brace, disposable between the wall panel and the support base to secure the wall panel and the support base in the inclined position.

4. A device in accordance with claim 1, wherein the support base and wall panel are pivotally coupled together and pivotal between a storage position and an inclined position.

5. A device in accordance with claim 1, wherein the wall panels include a corrugated wall membrane disposed on a frame.

6. A device in accordance with claim 1, wherein the plurality of modular walls and liner form a portable retention pond.

7. A device in accordance with claim 1, further comprising an opening associated with one of the wall panels and the liner, the opening being sized and shaped to allow water to fill or drain from the above ground water storage device.

8. A device in accordance with claim 1, further comprising a cover, sized and shaped to fit over the above ground storage device.

9. An above ground water storage device, comprising:

a) a plurality of modular walls, coupled together in series to form a substantially continuous perimeter, each of the plurality of modular walls further including:

i) a wall panel, inclinable with respect to a horizontal orientation at an inclined angle; and ii) a support base, coupleable to an A-frame portion of the wall panel, the support base further including:

(1) two legs defining a horizontal A-frame shape with a proximal end of each leg adjacent each other and a distal end of each leg spaced apart from one another;

(2) a cross brace extending between the legs intermediate the proximal and distal ends; and (3) a truss having an upper leg member and a lower leg member with the upper leg member extending upward along the inclined wall panel and the lower leg member coupled to one of the A-frame legs;

b) a liner, covering an internal side of the plurality of modular walls and an area encompassed by the continuous perimeter; and c) at least one modular corner wall, positioned with the plurality of modular wall panels to form a corner in the substantially continuous perimeter, the at least one modular corner wall having an angled side with an angle corresponding to the angle of the inclined angle of an adjacent modular wall.

* * * * *